US011185137B2

(12) United States Patent
Tashjian

(10) Patent No.: US 11,185,137 B2
(45) Date of Patent: Nov. 30, 2021

(54) EARRINGS AND METHODS OF MANUFACTURE AND USE THEREOF

(71) Applicant: Venus by Maria Tash, Inc., New York, NY (US)

(72) Inventor: Maria Tashjian, New York, NY (US)

(73) Assignee: Venus by Maria Tash, Inc., New York, NY (US)

( * ) Notice: Subject to any disclaimer, the term of this patent is extended or adjusted under 35 U.S.C. 154(b) by 0 days.

(21) Appl. No.: 17/191,282

(22) Filed: Mar. 3, 2021

(65) Prior Publication Data

US 2021/0267327 A1 Sep. 2, 2021

Related U.S. Application Data

(63) Continuation-in-part of application No. 29/749,236, filed on Sep. 3, 2020, and a continuation-in-part of application No. 17/163,825, filed on Feb. 1, 2021, which is a continuation of application No. 17/013,826, filed on Sep. 7, 2020, now Pat. No. 10,905,206, which is a continuation-in-part of application No. 29/725,811, filed on Feb. 27, 2020, and a continuation-in-part of application No. 29/749,236, filed on Sep. 3, 2020, application No. 17/191,282, which is a continuation-in-part of application No. 29/770,412, filed on Feb. 11, 2021, and a continuation-in-part of application No. 29/770,416, filed on Feb. 11, 2021.

(51) Int. Cl.
*A44C 7/00* (2006.01)

(52) U.S. Cl.
CPC ..... *A44C 7/003* (2013.01)

(58) Field of Classification Search
CPC ..... A44C 7/003; A44C 7/00; A44C 7/001; A44C 7/002; A44C 15/0025
USPC ..... 63/40, 41, 31, 14.5, 12, 13; D11/40, 43, D11/44, 45, 75
See application file for complete search history.

(56) References Cited

U.S. PATENT DOCUMENTS

| | | | | | |
|---|---|---|---|---|---|
| 2,598,281 | A * | 5/1952 | Meeker | A44B 5/002 | 24/97 |
| 3,613,393 | A | 10/1971 | Lamoureux | 63/145 | |
| 5,170,643 | A * | 12/1992 | Porcell, Jr. | A44C 7/003 | 63/12 |
| 5,505,061 | A * | 4/1996 | Fleury, Jr. | A44C 7/002 | 63/13 |
| 6,032,486 | A | 3/2000 | Uchin | 63/31 | |

(Continued)

FOREIGN PATENT DOCUMENTS

| | | | |
|---|---|---|---|
| CN | 208388002 U | 1/2019 | A44C 15/0025 |
| CN | 209421124 U | 9/2019 | A44C 15/0025 |

(Continued)

*Primary Examiner* — Jack W Lavinder
(74) *Attorney, Agent, or Firm* — Dentons US LLP

(57) ABSTRACT

Generally, this disclosure enables various earrings and methods of manufacture and use thereof. For example, some of these earrings are selectively reversible between different aesthetic appearances for wearing to different occasions. This selective reversibility is enabled through various modalities of operation (e.g., clock-like action, spinning action). These modalities of operation are technologically beneficial because these modalities of operation enable such earrings to be selectively reversed from various ear portions.

30 Claims, 18 Drawing Sheets

(56) References Cited

U.S. PATENT DOCUMENTS

| | | | | |
|---|---|---|---|---|
| 6,550,276 | B2 | 4/2003 | Frank | 63/31 |
| 2003/0089130 | A1* | 5/2003 | Quach | A44C 15/001 63/31 |
| 2008/0016911 | A1 | 1/2008 | Morgan | 63/12 |
| 2015/0308489 | A1* | 10/2015 | Yakubovich | A44C 15/0025 63/10 |

FOREIGN PATENT DOCUMENTS

| | | | | |
|---|---|---|---|---|
| JP | 3000814 | U | 8/1994 | A44C 15/0025 |
| JP | 2016202634 | A | 12/2016 | A44C 7/006 |

* cited by examiner

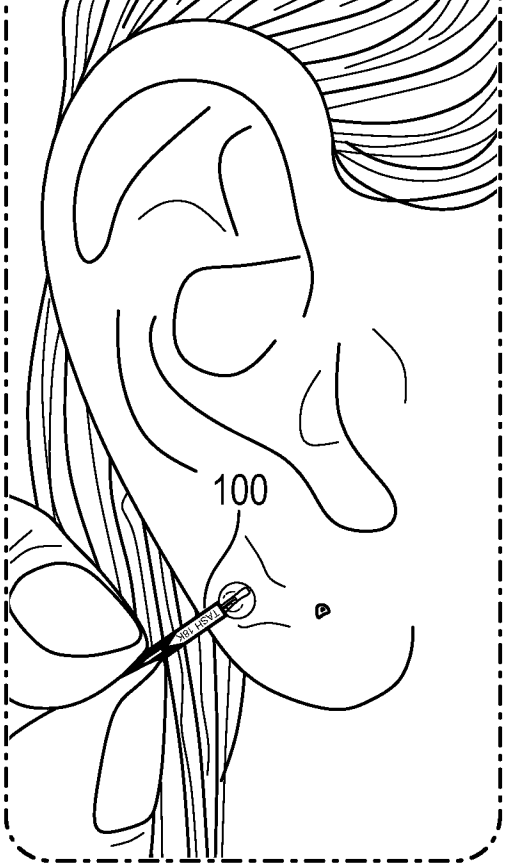
FIG. 28
FIG. 29
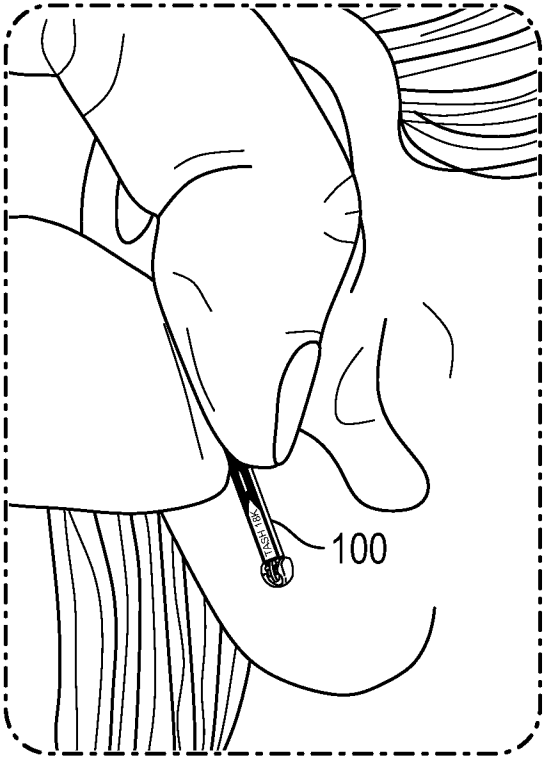
FIG. 30

EARRINGS AND METHODS OF MANUFACTURE AND USE THEREOF

CROSS-REFERENCE TO RELATED PATENT APPLICATIONS

This patent application is a continuation-in-part of U.S. Design patent application Ser. No. 29/749,236, filed 3 Sep. 2020, which is incorporated by reference herein for all purposes.

This patent application is a continuation-in-part of U.S. Utility patent application Ser. No. 17/163,825, filed 1 Feb. 2021, which is a continuation of U.S. Utility patent application Ser. No. 17/013,826, filed 7 Sep. 2020, now U.S. Pat. No. 10,905,206 issued 2 Feb. 2021, which is (1) a continuation-in-part of U.S. Design patent application 29/725,811, filed 27 Feb. 2020, and (2) a continuation-in-part of U.S. Design patent application 29/749,236, filed 3 Sep. 2020; each of which is incorporated by reference herein for all purposes.

This patent application is a continuation-in-part of U.S. Design patent application 29/770,412, filed 11 Feb. 2021, which is incorporated by reference herein for all purposes.

This patent application is a continuation-in-part of U.S. Design patent application 29/770,416, filed 11 Feb. 2021, which is incorporated by reference herein for all purposes.

TECHNICAL FIELD

This disclosure relates to earrings and methods of manufacture and use thereof.

BACKGROUND

A person often desires to wear different pairs of earrings for different occasions. For example, the person may wear a first pair of earrings with a first aesthetic appearance to a first event (e.g., a professional conference) and a second pair of earrings with a second aesthetic appearance, different from the first aesthetic appearance, to a second event (e.g., a personal party). However, such desire may be difficult to attain. For example, the person may have nowhere to carry another pair of earrings, the person may have forgotten the second pair of earrings at home, the person may have lost or broke the second pair of earrings before the second event, the person may not want to remove the first pair of earrings to insert the second pair of earrings, the person may not be able to afford the second pair of earrings, or other reasons.

SUMMARY

Generally, this disclosure enables various earrings and methods of manufacture and use thereof. For example, some of these earrings are selectively reversible between different aesthetic appearances for wearing to different occasions or for aesthetically matching with different items of clothing. This selective reversibility is enabled through various modalities of operation (e.g., clock-like action, spinning action). These modalities of operation are technologically beneficial because these modalities of operation enable such earrings to be selectively reversed from various ear portions.

In an embodiment, an earring comprises: a post including a first end portion and a second end portion, wherein the first end portion opposes the second end portion; a frontal piece including a base, a first wall, a second wall, and a bridge, wherein the base is secured to the first end portion, wherein the first wall extends from the base, wherein the second wall extends from the base, wherein the first wall and the second wall oppose each other, wherein the first wall and the second wall are spaced apart from each other such that a volume of space extends therebetween, wherein the bridge spans between the first wall and the second wall along the volume of space; a ring looped over the bridge between the first wall and the second wall such that the ring is configured to (a) freely slide along the bridge between the first wall and the second wall and (b) freely rotate about the bridge between the first wall and the second wall; and a decorative piece secured to the ring, wherein the decorative piece has a first side and a second side, wherein the first side opposes the second side, wherein the first side has a first decorative face, wherein the second side has a second decorative face, wherein the first decorative face is aesthetically different from the second decorative face, wherein the frontal piece is configured to rotate relative to an ear of a wearer based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

In an embodiment, a method comprises: manufacturing an earring comprising a post, a frontal piece, a ring, and a decorative piece, wherein the post including a first end portion and a second end portion, wherein the first end portion opposes the second end portion, wherein the frontal piece including a base, a first wall, a second wall, and a bridge, wherein the base is secured to the first end portion, wherein the first wall extends from the base, wherein the second wall extends from the base, wherein the first wall and the second wall oppose each other, wherein the first wall and the second wall are spaced apart from each other such that a volume of space extends therebetween, wherein the bridge spans between the first wall and the second wall along the volume of space, wherein the ring is looped over the bridge between the first wall and the second wall such that the ring is configured to (a) freely slide along the bridge between the first wall and the second wall and (b) freely rotate about the bridge between the first wall and the second wall, wherein the decorative piece is secured to the ring, wherein the decorative piece has a first side and a second side, wherein the first side opposes the second side, wherein the first side has a first decorative face, wherein the second side has a second decorative face, wherein the first decorative face is aesthetically different from the second decorative face; and instructing a wearer to rotate the frontal piece relative to the ear based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

In an embodiment, a method comprises: causing a wearer having an ear to receive an earring comprising a post, a frontal piece, a ring, and a decorative piece, wherein the post including a first end portion and a second end portion, wherein the first end portion opposes the second end portion, wherein the frontal piece including a base, a first wall, a second wall, and a bridge, wherein the base is secured to the first end portion, wherein the first wall extends from the base, wherein the second wall extends from the base, wherein the first wall and the second wall oppose each other, wherein the first wall and the second wall are spaced apart from each other such that a volume of space extends therebetween, wherein the bridge spans between the first wall and the second wall along the volume of space, wherein the ring is looped over the bridge between the first wall and the second wall such that the ring is configured to (a) freely slide along the bridge between the first wall and the second wall and (b) freely rotate about the bridge between the first wall and the second wall, wherein the decorative piece is secured to the ring, wherein the decorative piece has a first side and a second side, wherein the first side opposes the second side, wherein the first side has a first decorative face, wherein the second side has a second decorative face, wherein the first decorative face is aesthetically different from the second decorative face; and causing the wearer to rotate the frontal piece relative to the ear based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

DESCRIPTION OF DRAWINGS

FIGS. 28-32 illustrate a plurality of perspective view of an embodiment of an earring worn on an ear of a person and being reversed via rotation relative to the ear according to this disclosure.

DETAILED DESCRIPTION

Figure 1:
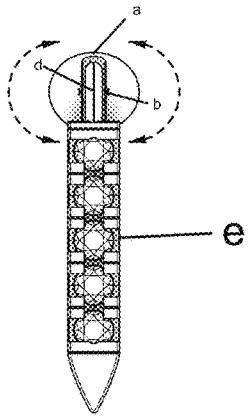
FIGS. 1-9 illustrate various views of an embodiment of an earring being reversed via rotation according to this disclosure.
Figure 2:
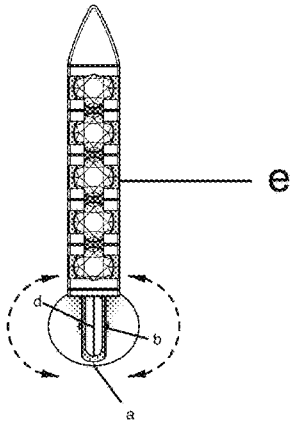
Figure 3:
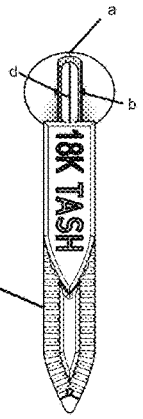
Figure 4:
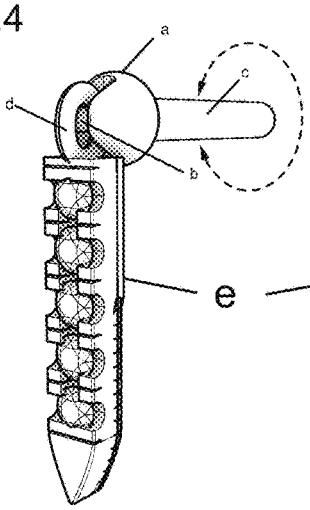
Figure 5:
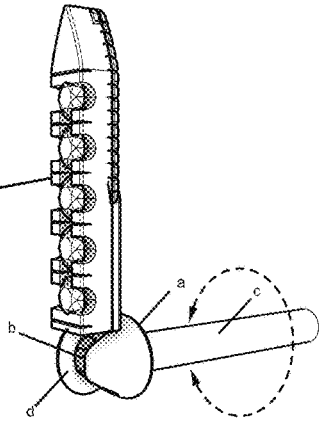
Figure 6:
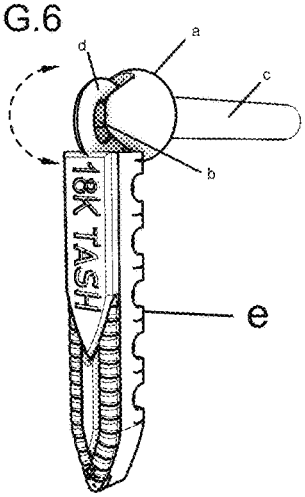
Figure 7:
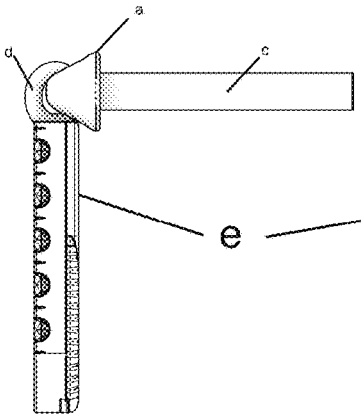
Figure 8:
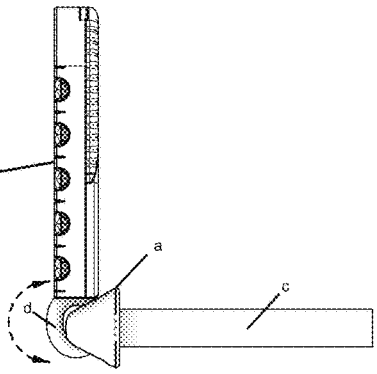
Figure 9:
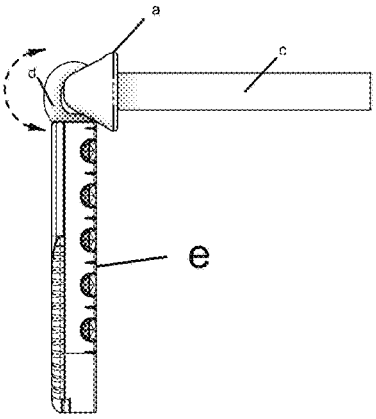

Generally, this disclosure enables various earrings and methods of manufacture and use thereof. For example, some of these earrings are selectively reversible between different aesthetic appearances for wearing to different occasions. This selective reversibility is enabled through various modalities of operation (e.g., clock-like action, spinning action). These modalities of operation are technologically beneficial because these modalities of operation enable such earrings to be selectively reversed from various ear portions. However, note that this disclosure may be embodied in many different forms and should not be construed as necessarily being limited to various embodiments disclosed herein. Rather, these embodiments are provided so that this disclosure is thorough and complete, and fully conveys various concepts of this disclosure to skilled artisans.

Various terminology used herein can imply direct or indirect, full or partial, temporary or permanent, action or inaction. For example, when an element is referred to as being "on," "connected," or "coupled" to another element, then the element can be directly on, connected, or coupled to another element or intervening elements can be present, including indirect or direct variants. In contrast, when an element is referred to as being "directly connected" or "directly coupled" to another element, then there are no intervening elements present.

As used herein, various singular forms "a," "an" and "the" are intended to include various plural forms (e.g., two, three, four, five, six, seven, eight, nine, ten, tens, hundreds, thousands) as well, unless specific context clearly indicates otherwise.

As used herein, various presence verbs "comprises," "includes" or "comprising," "including" when used in this specification, specify a presence of stated features, integers, steps, operations, elements, or components, but do not preclude the presence or addition of one or more other features, integers, steps, operations, elements, components, or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

As used herein, a term "or others," "combination", "combinatory," or "combinations thereof" refers to all permutations and combinations of listed items preceding that term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. Skilled artisans understand that typically there is no limit on number of items or terms in any combination, unless otherwise apparent from the context.

As used herein, unless otherwise defined, all terms (including technical and scientific terms) used herein have the same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized or overly formal sense unless expressly so defined herein.

As used herein, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

As used herein, a term "about" or "substantially" refers to a +/−10% variation from a nominal value/term. Such variation is always included in any given value/term provided herein, whether or not such variation is specifically referred thereto.

Features described with respect to certain embodiments may be combined in or with various some embodiments in any permutational or combinatory manner. Different aspects or elements of example embodiments, as disclosed herein, may be combined in a similar manner.

Although various terms first, second, third, and so forth can be used herein to describe various elements, components, regions, layers, or sections, these elements, components, regions, layers, or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Features described with respect to certain example embodiments can be combined and sub-combined in or with various other example embodiments. Also, different aspects or elements of example embodiments, as disclosed herein, can be combined and sub-combined in a similar manner as well. Further, some example embodiments, whether individually or collectively, can be components of a larger system, wherein other procedures can take precedence over or otherwise modify their application. Additionally, a number of steps can be required before, after, or concurrently with example embodiments, as disclosed herein. Note that any or all methods or processes, at least as disclosed herein, can be at least partially performed via at least one entity in any manner.

Example embodiments of this disclosure are described herein with reference to illustrations of idealized embodiments (and intermediate structures) of this disclosure. As such, variations from various illustrated shapes as a result, for example, of manufacturing techniques or tolerances, are to be expected. Thus, various example embodiments of this disclosure should not be construed as necessarily limited to various particular shapes of regions illustrated herein, but are to include deviations in shapes that result, for example, from manufacturing.

Any or all elements, as disclosed herein, can be formed from a same, structurally continuous piece, such as being unitary, or be separately manufactured or connected, such as being an assembly or modules. Any or all elements, as disclosed herein, can be manufactured via any manufacturing processes, whether additive manufacturing, subtractive manufacturing, or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Figure 10:
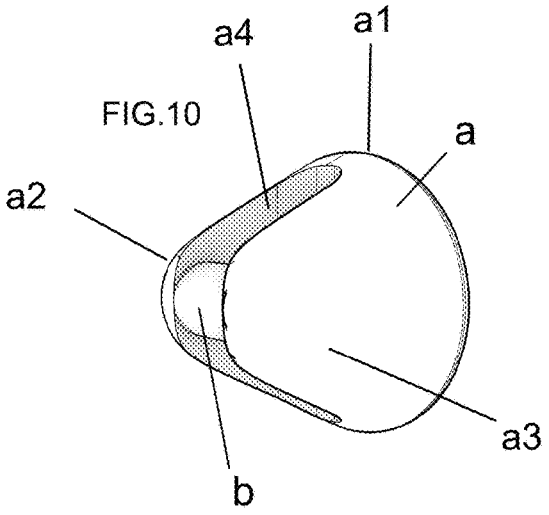
FIGS. 10-12 illustrate a plurality of perspective views of a plurality of embodiments of a plurality of components of an earring according to this disclosure.
Figure 11:
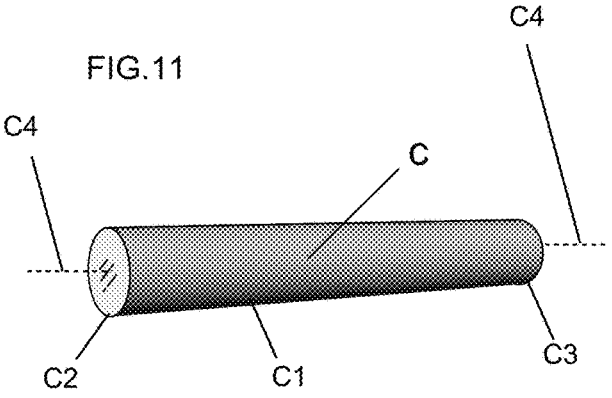
Figure 12:
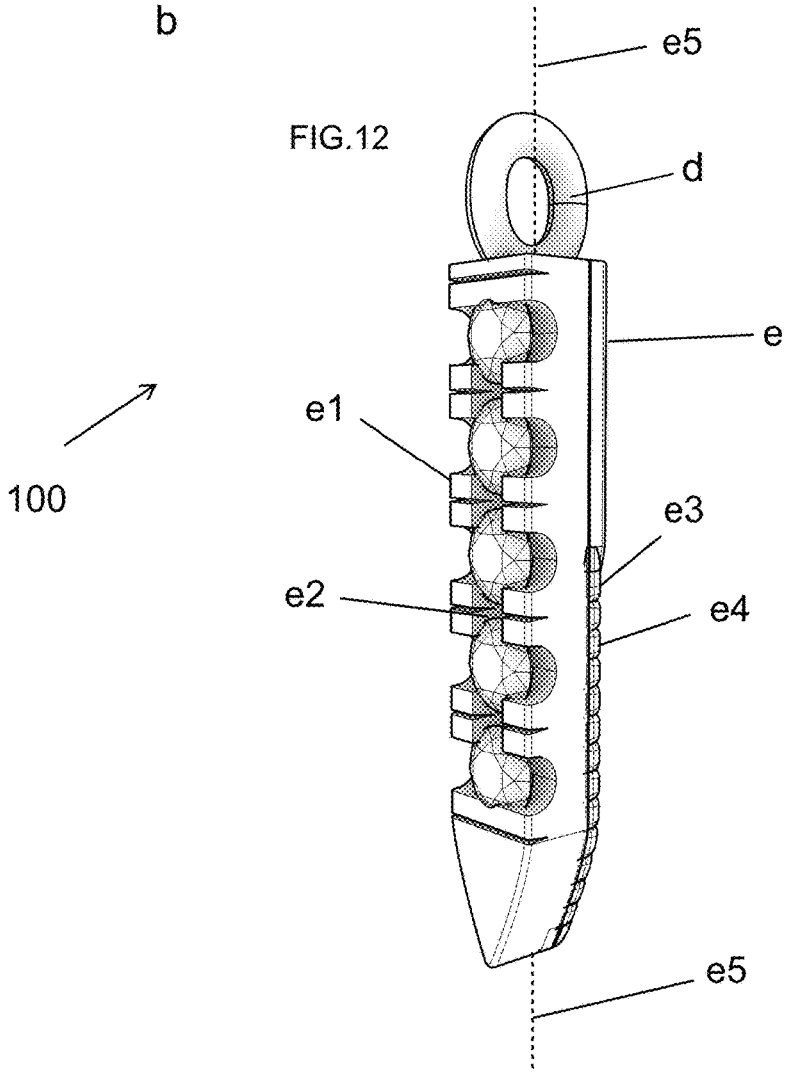
Figure 13:
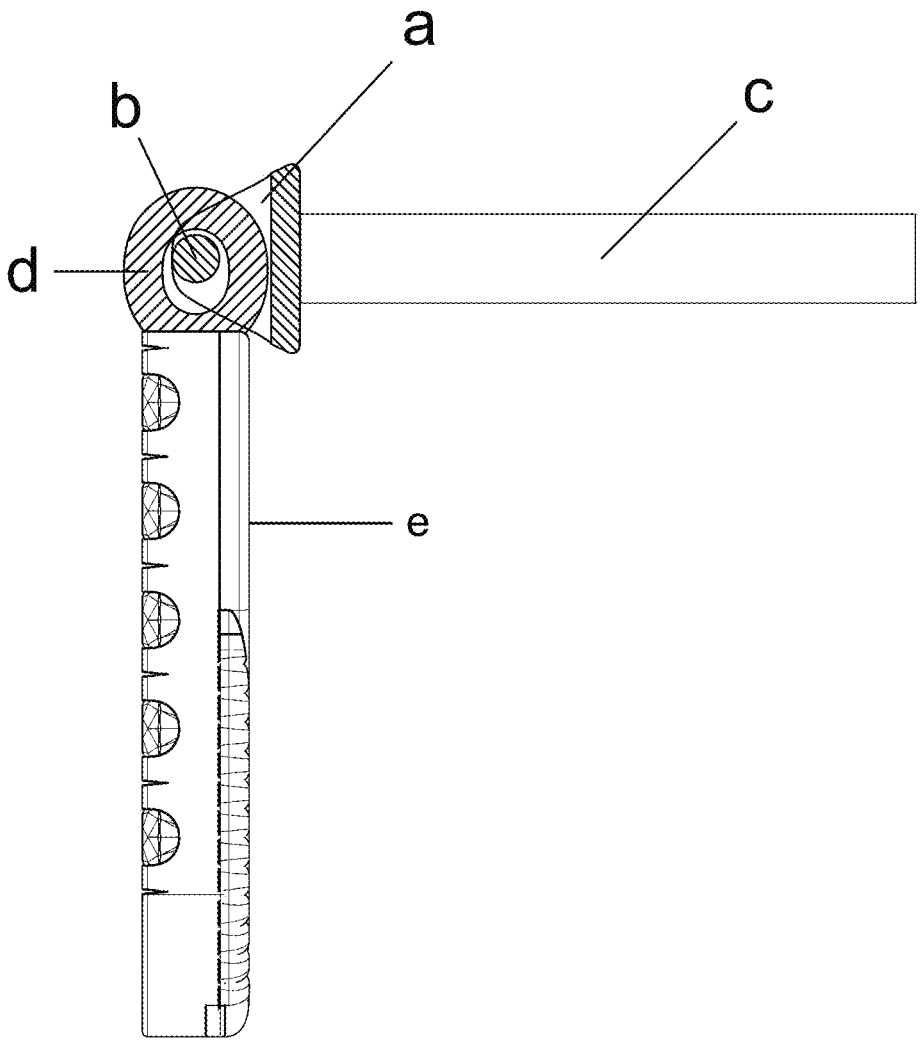
FIG. 13 illustrates a cross-sectional view of an embodiment of an earring configured for reversal via rotation according to this disclosure.
Figure 14:
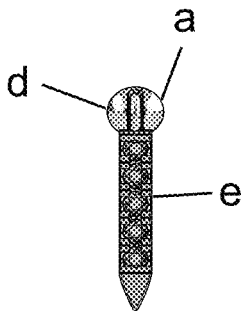
FIGS. 14-22 illustrate various views of an embodiment of an earring being reversed via rotation according to this disclosure.
Figure 15:
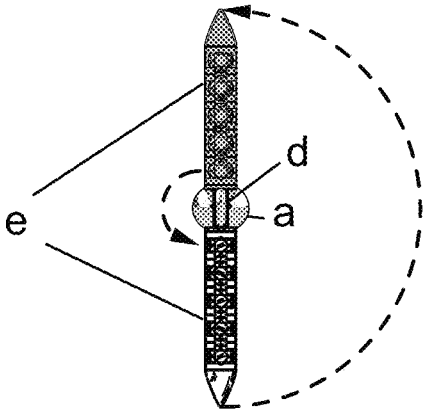
Figure 16:
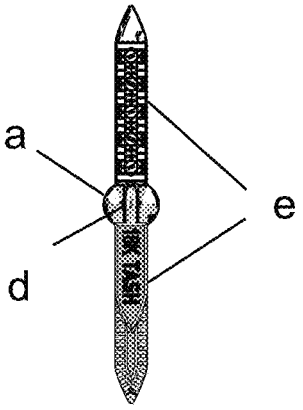
Figures 17, 18, 19:
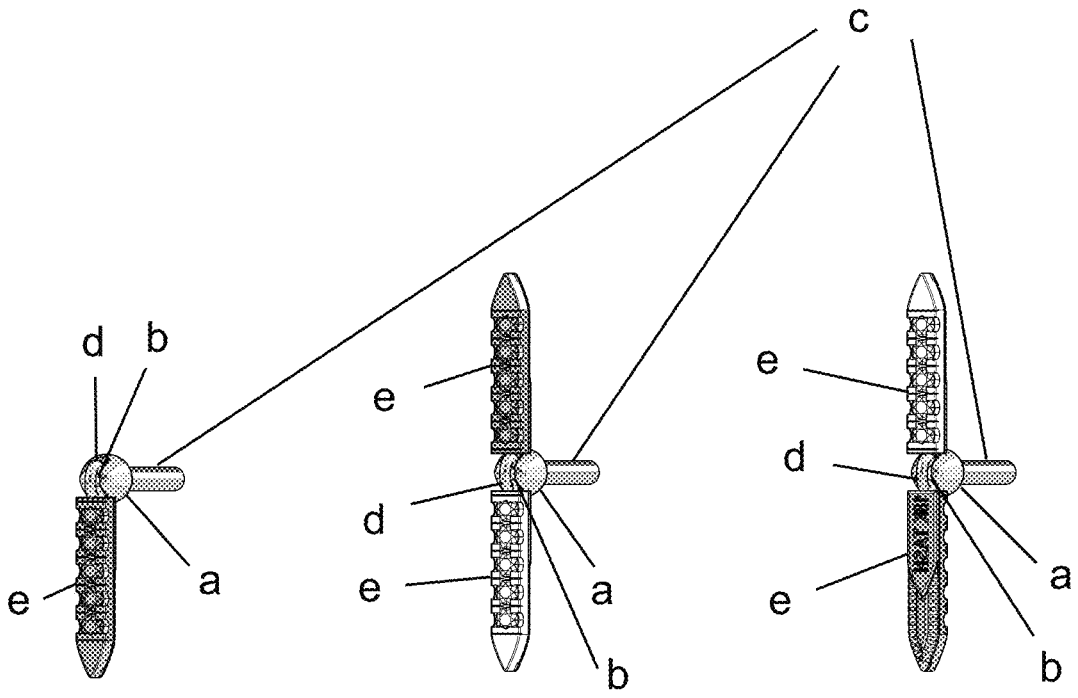
Figure 20:
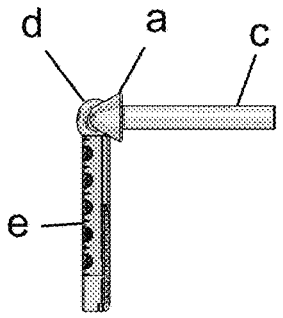
Figure 21:
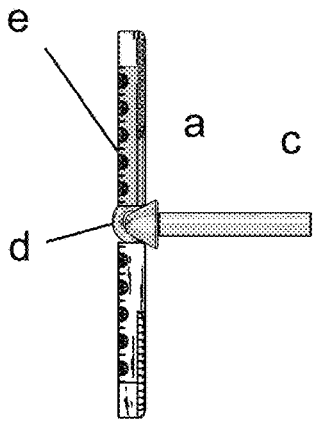
Figure 22:
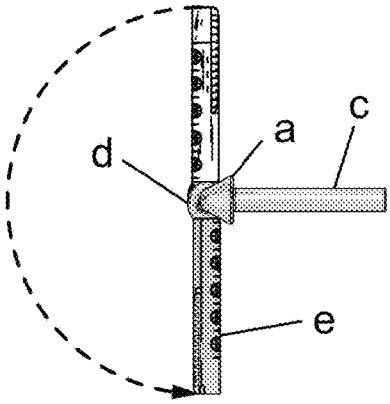
Figure 23:
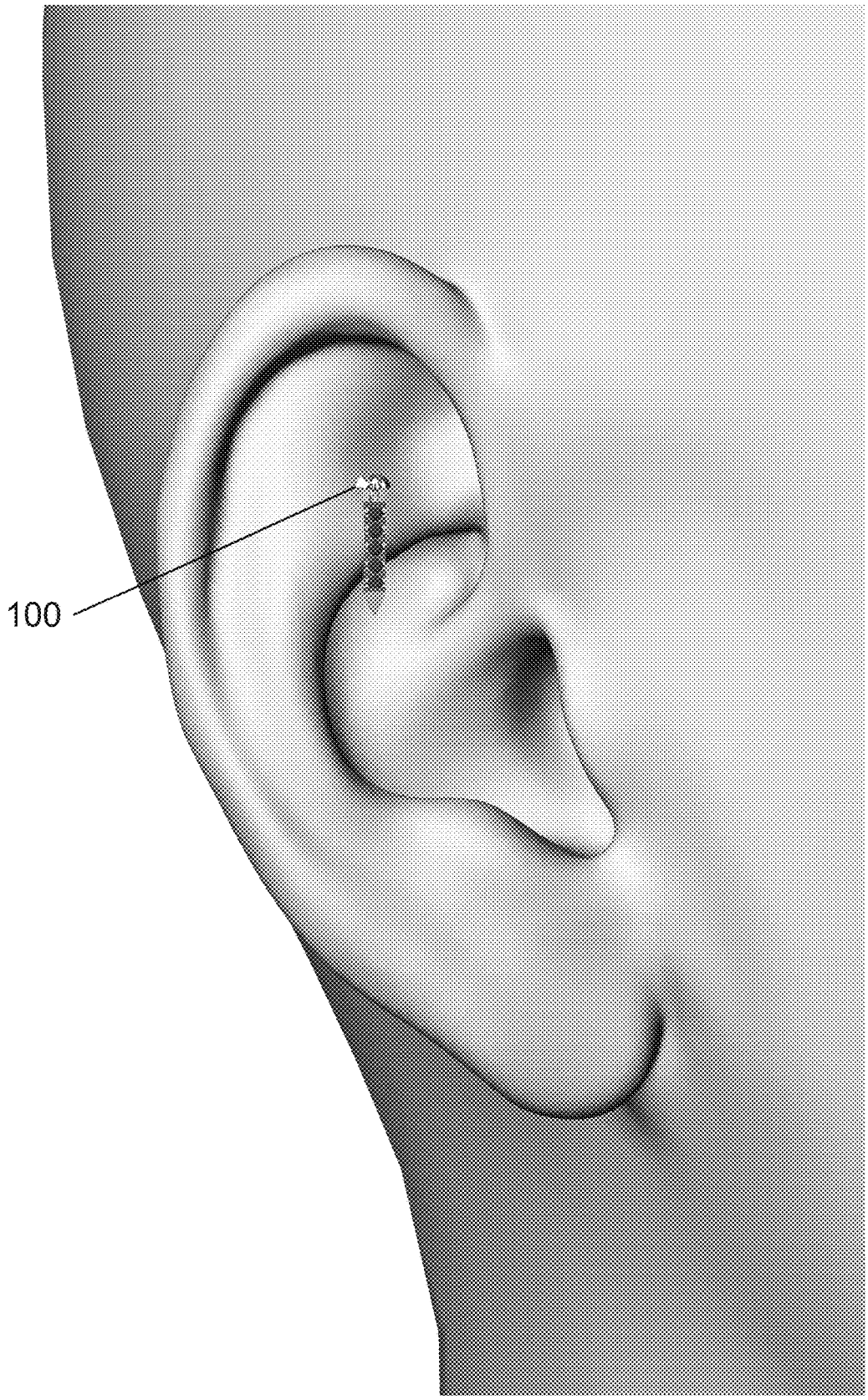
FIG. 23 illustrates an perspective view of an embodiment of an earring having a first aesthetic face and a second aesthetic face, where the earring is worn on an ear of a wearer at a 6 o'clock position such that the first aesthetic face does not face the wearer and the second aesthetic face faces the wearer according to this disclosure.
Figure 24:
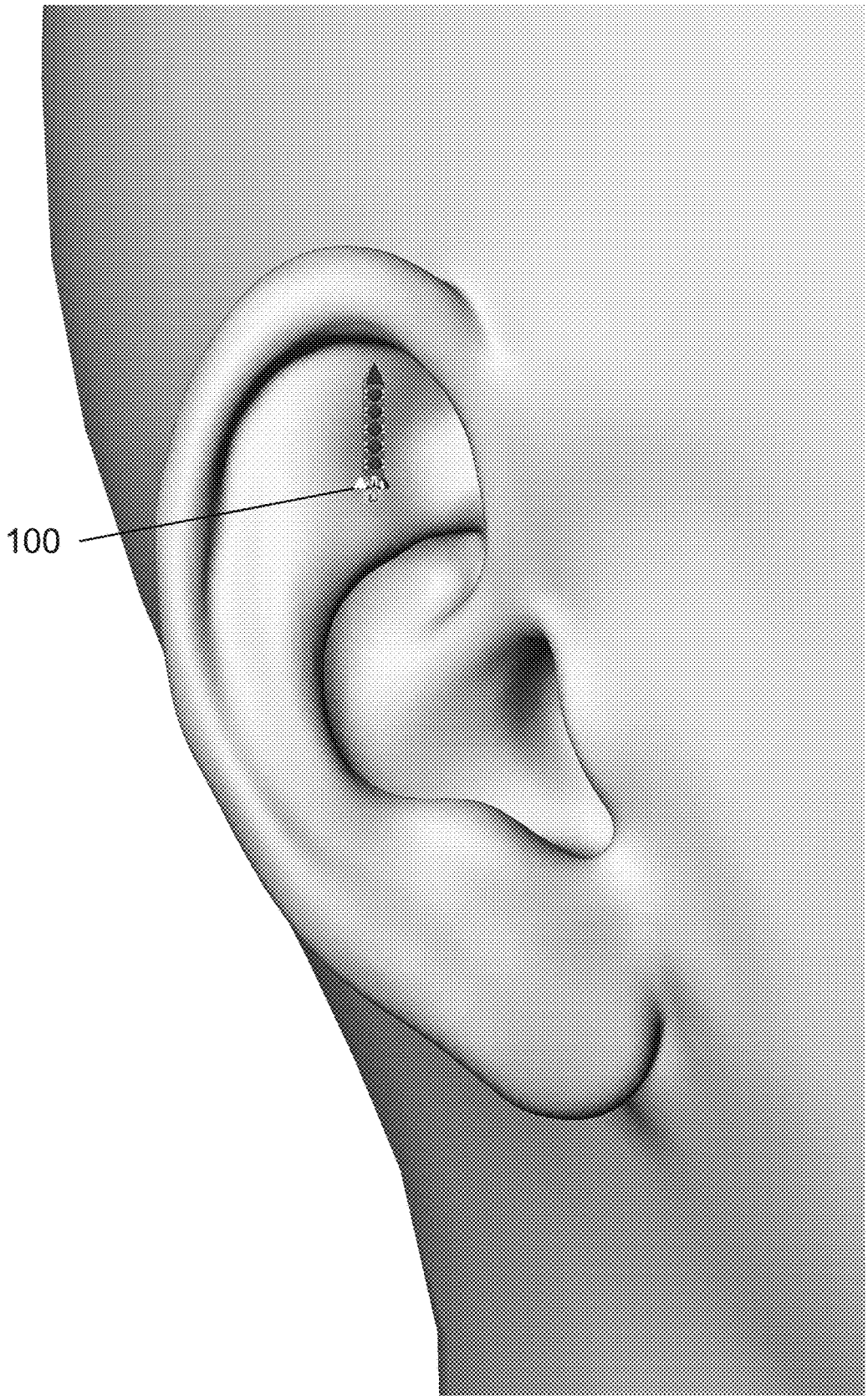
FIG. 24 illustrates a perspective view of the earring of FIG. 23 rotated to a 12 o'clock position relative to the ear such that the first aesthetic face does not face the wearer and the second aesthetic face faces the wearer according to this disclosure.
Figure 25:
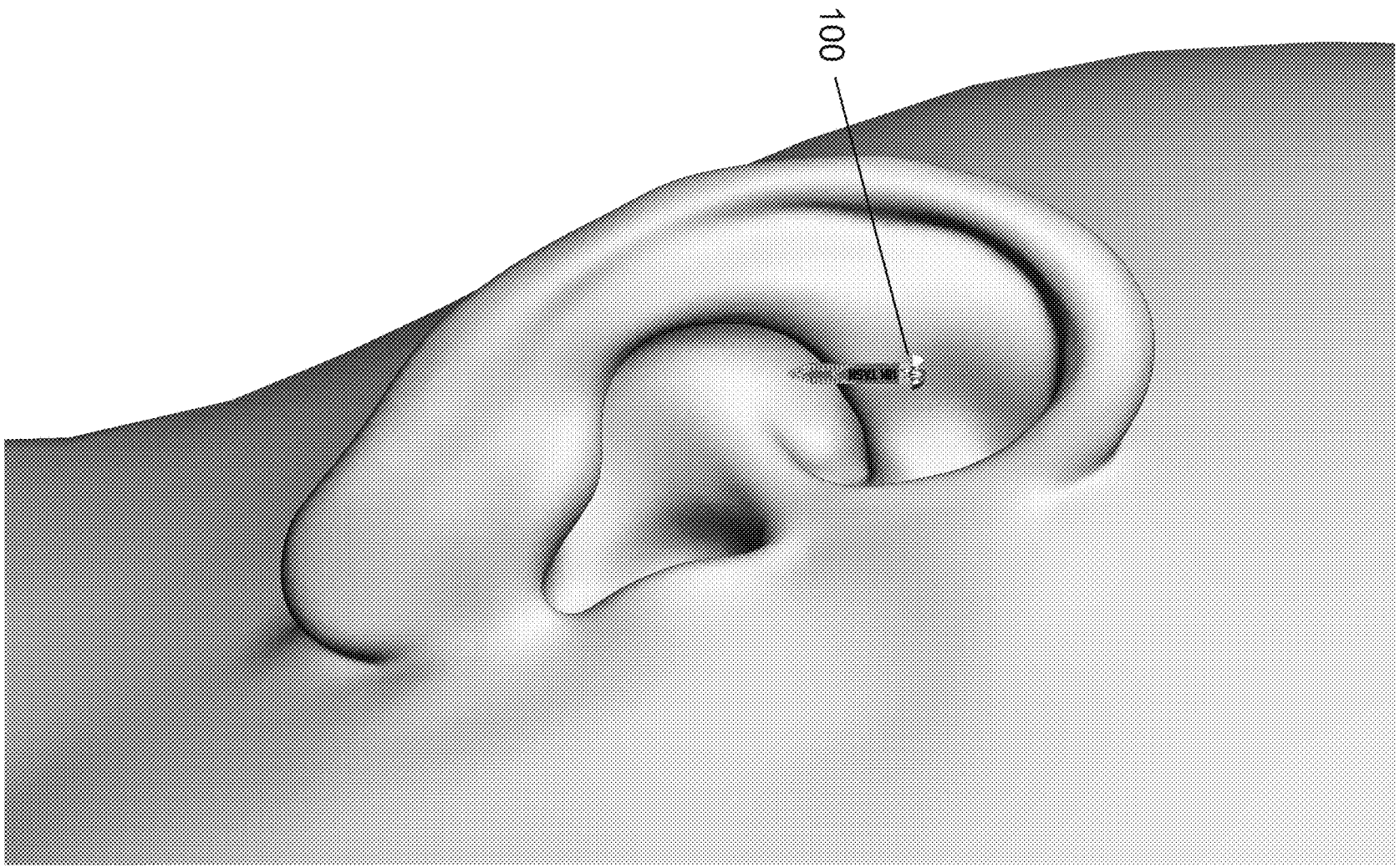
FIG. 25 illustrates a perspective view of the earring of FIG. 24 flipped to be reversed from the first aesthetic face to the second aesthetic face such that the first aesthetic face does face the wearer and the second aesthetic face does not face the wearer according to this disclosure.
Figure 26:
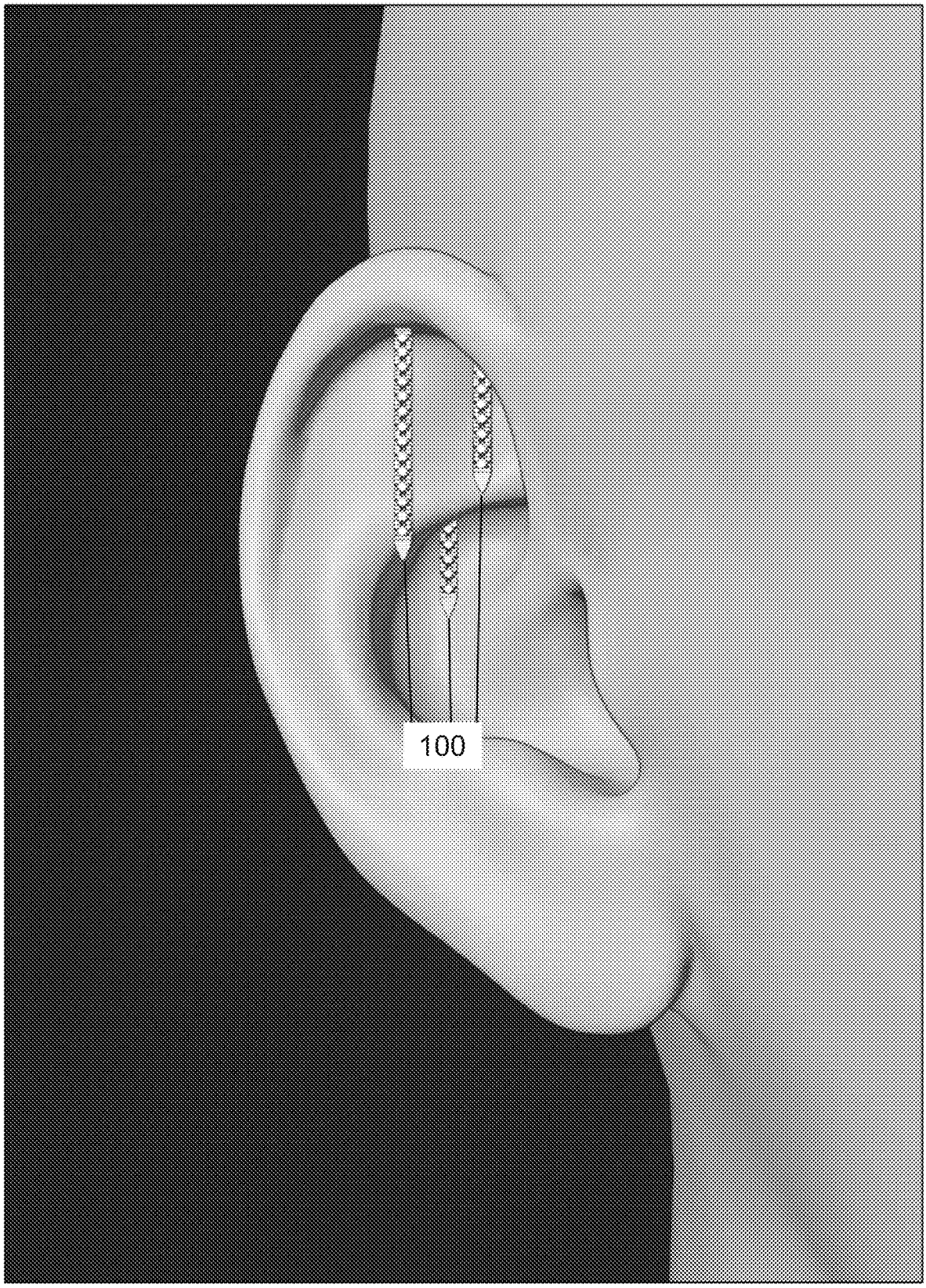
FIG. 26 illustrates a plurality of perspective views of a plurality of embodiments of a plurality of earrings being worn in a plurality of portions of an ear and configured for reversal via spinning according to this disclosure.
Figure 27:
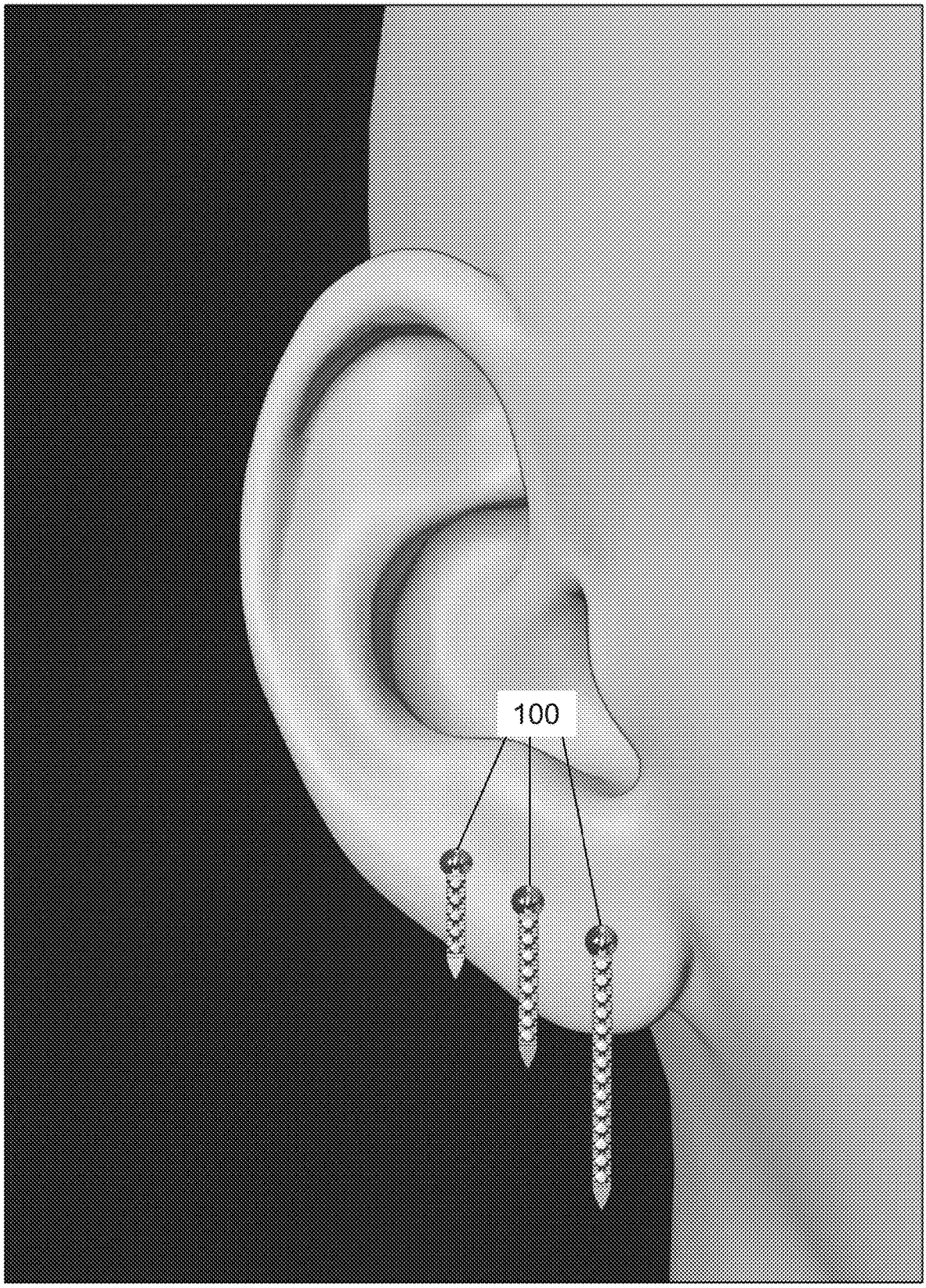
FIG. 27 illustrates a plurality of perspective views of a plurality of embodiments of a plurality of earrings being worn in a plurality of portions of an ear and configured for reversal via at least one of rotation or spinning according to this disclosure.
Figure 32:
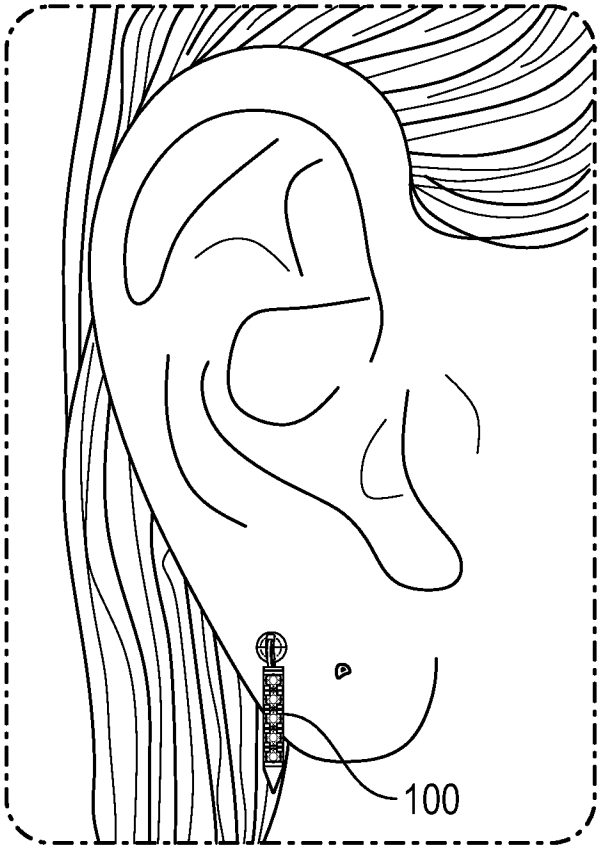
Figure 31:
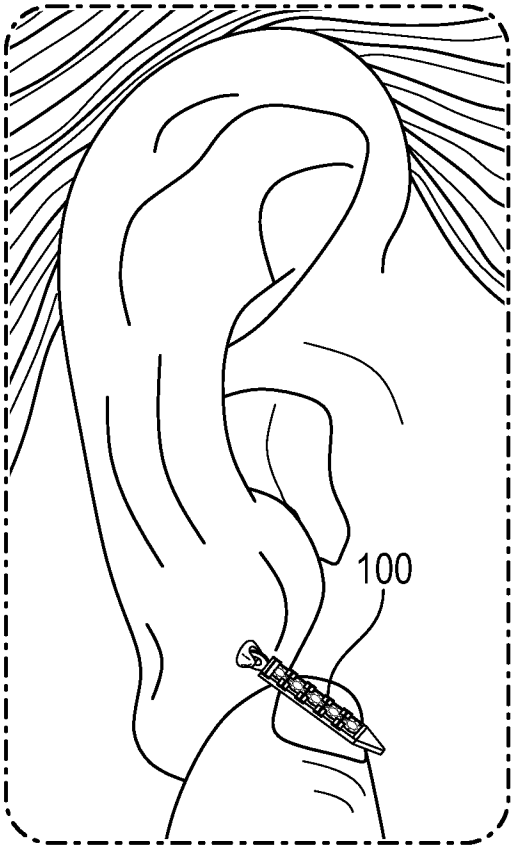
Figure 33:
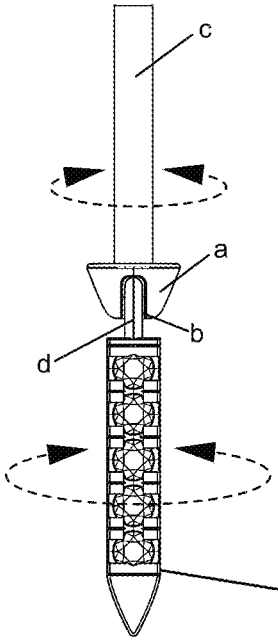
FIGS. 33-36 illustrate various views of an embodiment of an earring being reversed via spinning according to this disclosure.
Figure 34:
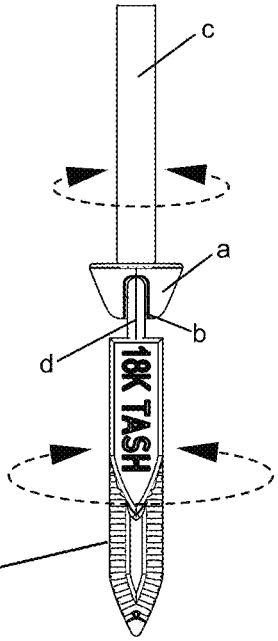
Figure 35:
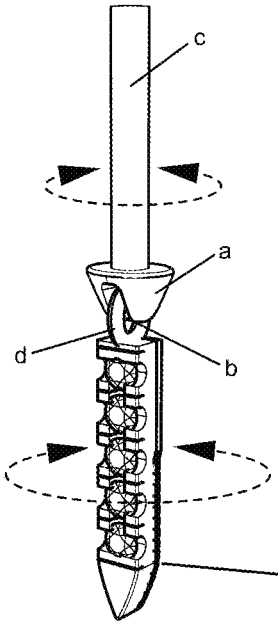
Figure 36:
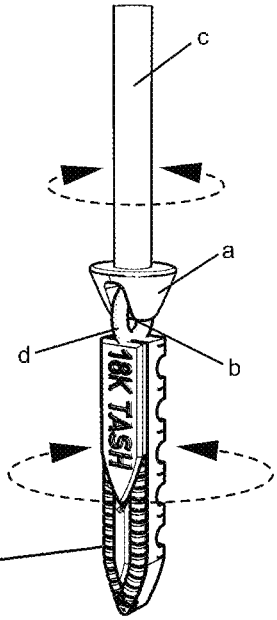
Figure 37:
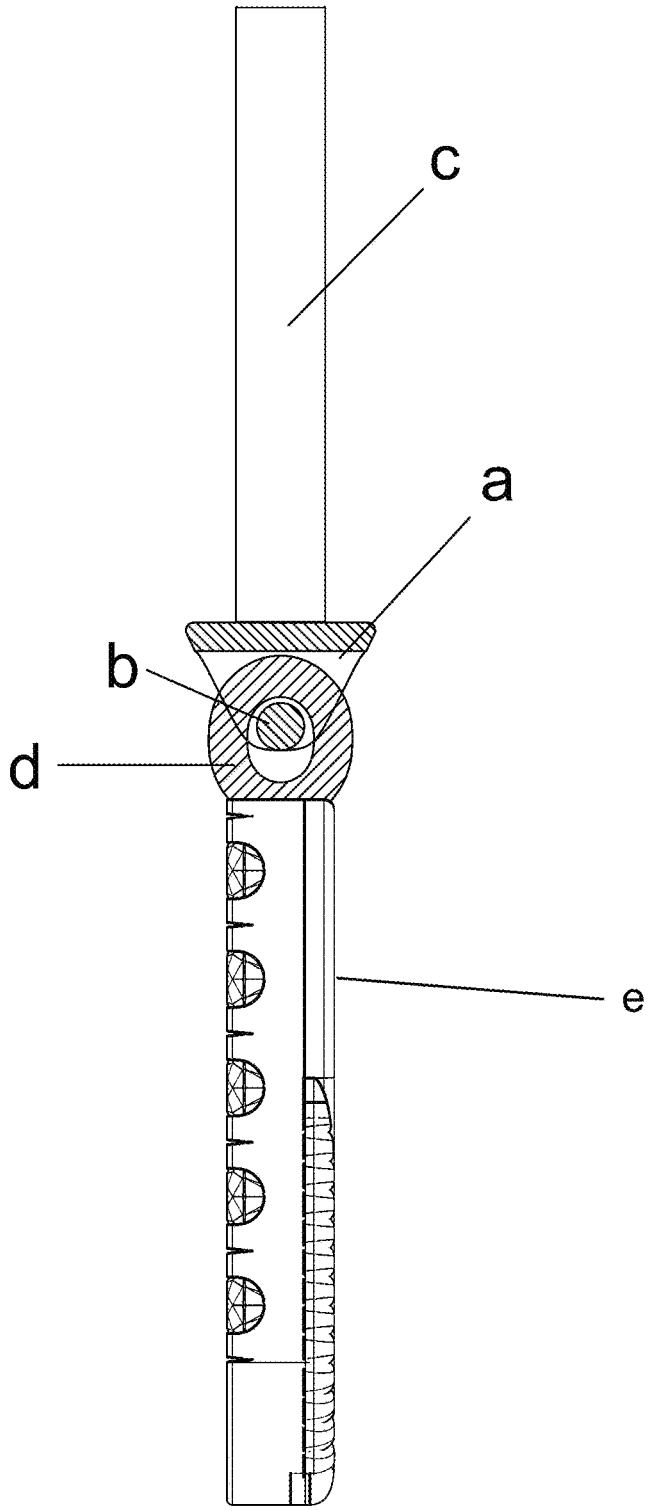
FIG. 37 illustrates a cross-sectional view of an embodiment of an earring configured for reversal via spinning according to this disclosure.
Figure 38:
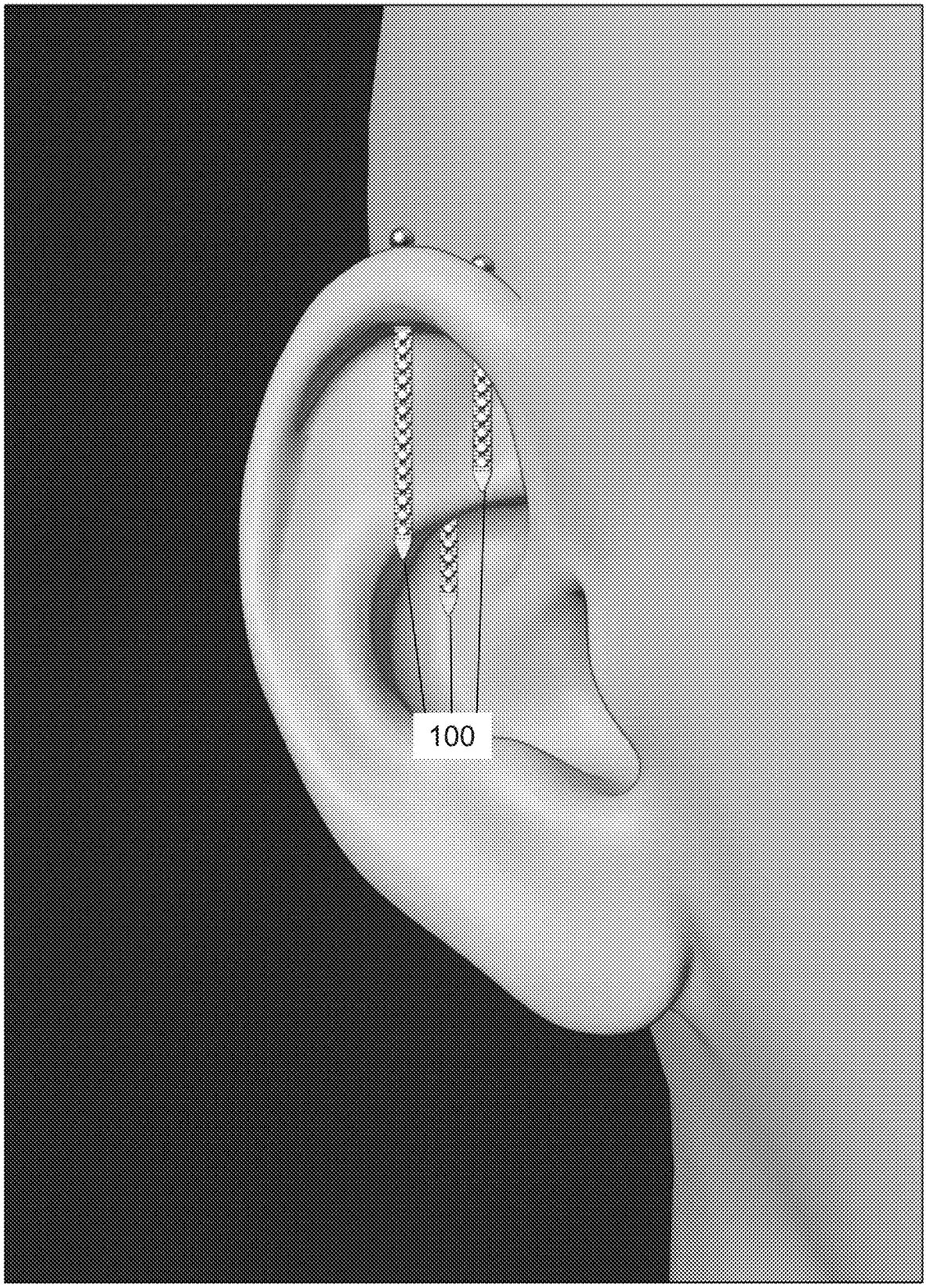
FIG. 38 illustrates a plurality of perspective views of a plurality of embodiments of a plurality of earrings configured for reversal via spinning according to this disclosure.
Figure 39:
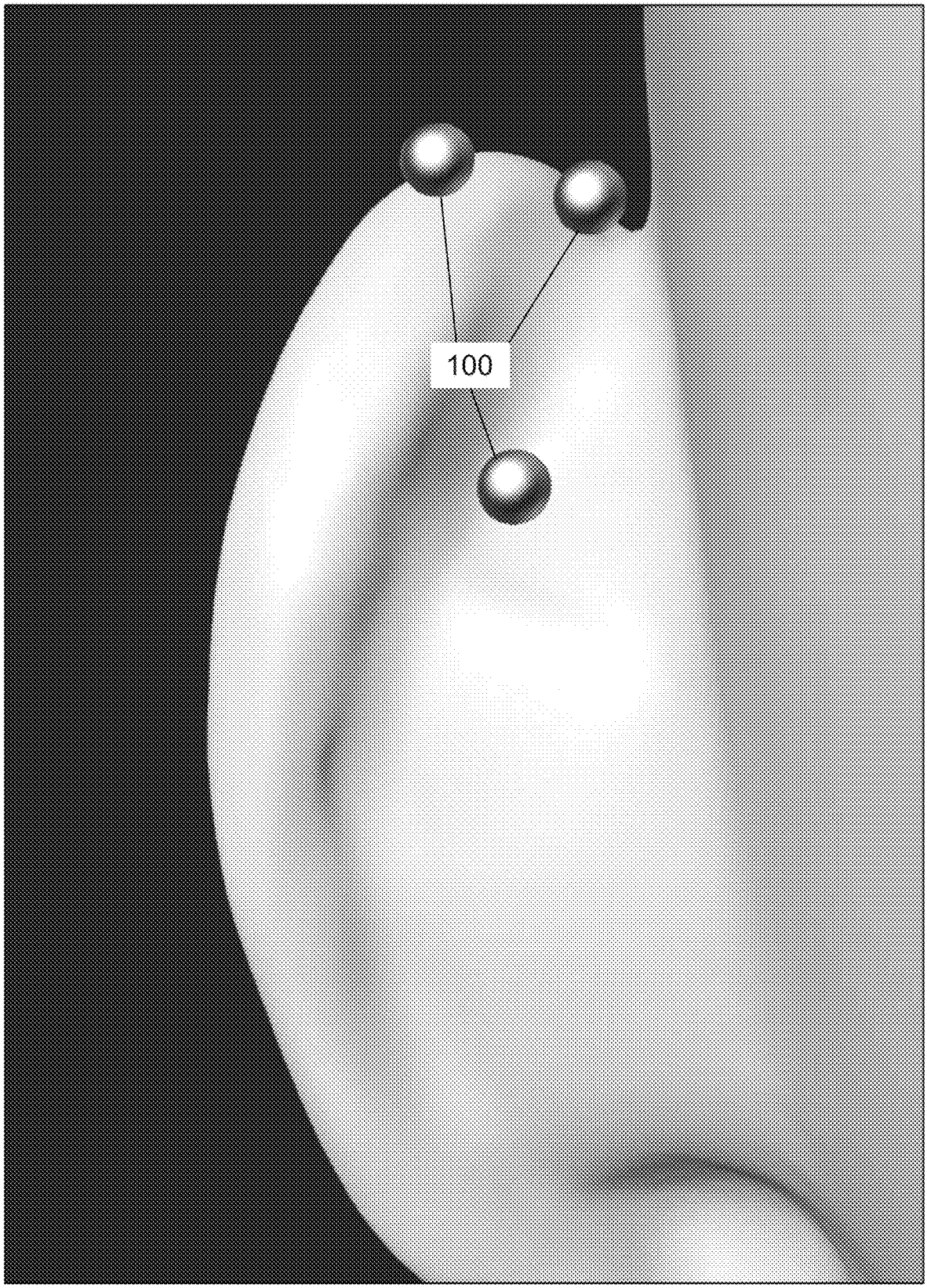
FIG. 39 illustrates a plurality of perspective views of a plurality of embodiments of a plurality of backings of a plurality of earrings configured for reversal via spinning according to this disclosure.
Figures 40, 41, 42, 43:
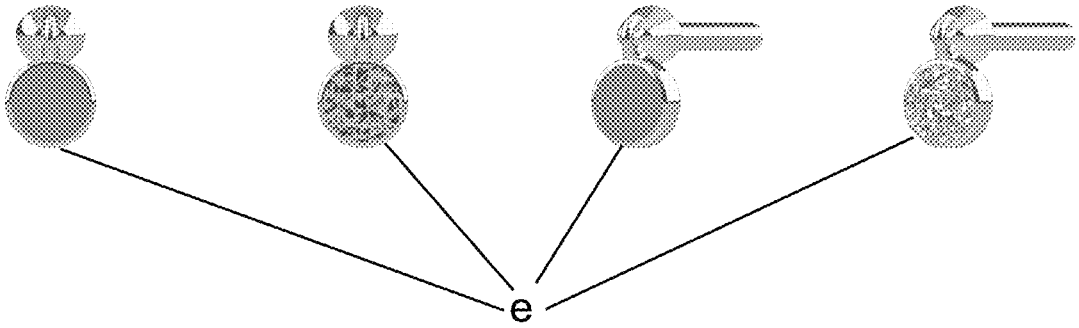
FIGS. 40-51 illustrate a plurality of views of a plurality of embodiments of a plurality of earrings with a plurality of decorative pieces that are reversible via rotation or spinning according to this disclosure.
Figures 44, 45, 46, 47:
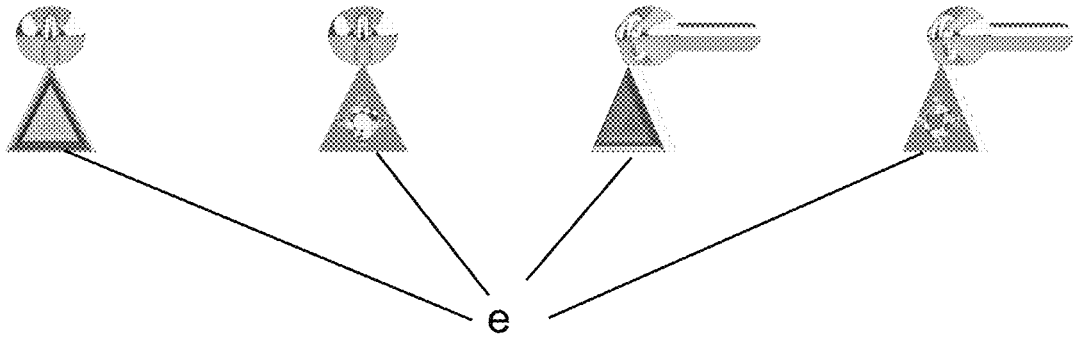
Figures 48, 49, 50, 51:
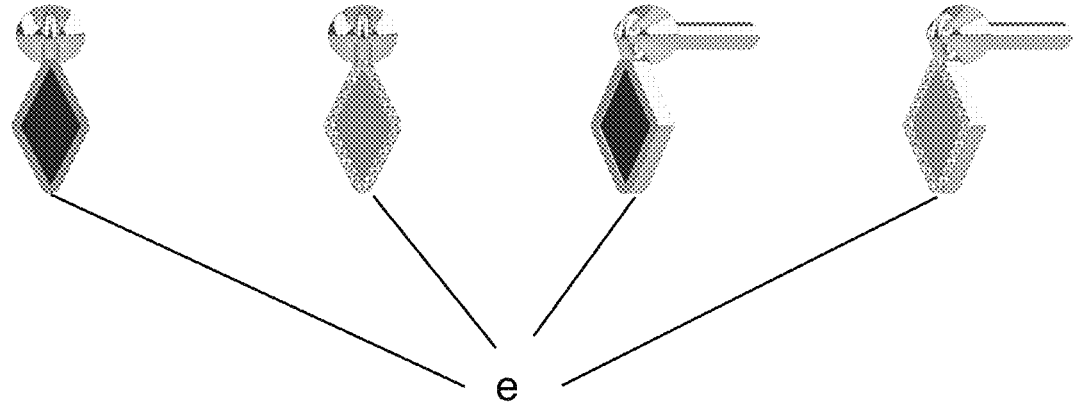

FIGS. 10-12 illustrate a plurality of perspective views of a plurality of embodiments of a plurality of components of an earring according to this disclosure. FIG. 13 illustrates a cross-sectional view of an embodiment of an earring configured for reversal via rotation according to this disclosure. FIG. 37 illustrates a cross-sectional view of an embodiment of an earring configured for reversal via spinning according to this disclosure. In particular, an earring 100 includes a post C, a frontal piece A, a bridge B, a ring D, and a decorative piece E.

The post C includes a body C1 having a first end portion C2 and a second end portion C3, where the first end portion C2 opposes the second end portion C3. The body C1 longitudinally extends along an axis C4 (e.g., an axis of rotation, an axis of symmetry), which extends through the first end portion C2 and the second end portion C3. The body C1 has a cross-section that is circular, but this shaping can vary (e.g., polygonal, oval, triangular, pentagonal, hexagonal, square, rectangular, symmetrical, asymmetrical, open-shape, closed-shape).

The body C1 is rectilinear in longitudinal extension, but can be non-rectilinear in longitudinal extension (e.g., helical, arcuate, sinusoidal). The body C1 includes an outer surface that is smooth, but can be non-smooth (e.g., rough, textured, knurled, bumped, spiked, depressed, threaded). The body C1 is internally solid (e.g., a bar), but can be hollow (e.g., a cylinder) or compartmentalized (e.g., with a set of compartments). The body C1 includes a metal or a metal alloy, but can include other materials (e.g., plastic, rubber, wood, silicon). The body C1 is rigid (e.g., unable to be manually bent), but can be flexible (e.g., able to be manually bent). The body C1 is monolithic (e.g., a single unit including a same material, additively manufactured, 3d printed, cast, injection molded), but can be an assembly of parts (e.g., by fastening, mating, interlocking).

Each of the first end portion C2 and the second end portion C3 is flat and closed. However, this configuration can vary. For example, at least one of the first end portion C2 or the second end portion C3 can be non-flat (e.g., conical, tapered, inwardly depressed, outwardly bumped) or open. For example, when at least one of the first end portion C2 or the second end portion C3 is open, the body C1 can be a tube, which can be internally threaded for receiving a correspondingly threaded surface.

Note that the post C can extend through an ear of a wearer between the first end portion C2 and the second end portion C3 when the body C1 extends through a portion of the ear of the wearer. For example, the portion of the ear can include an earlobe (lobule), a helix, a concha, a superior concha, a crus, a superior crus, an antitragus, an antihelix, a scapha, a triangular fossa, a concha cymba, a tragus, or other suitable portions of the ear. The body C1 can extend through the portion of the ear while the body C1 extends along at least one of a horizontal plane, a diagonal plane, a vertical plane, or a plane that is at least one of horizontal, diagonal, vertical, perpendicular, non-perpendicular, parallel, non-parallel to at least one of a sagittal plane of the wearer, a coronal plane of the wearer, or a transverse plane of the wearer.

The frontal piece A includes a base A1, a first wall A2, a second wall A3, and a volume of space A4. The base A1 includes a disc having a shape that is circular, but this shaping can vary (e.g., polygonal, square, rectangular, pentagonal, hexagonal, triangular, symmetrical, asymmetrical, open-shape, closed-shape). The disc of the base A1 has an outer surface that is smooth, flat, and closed, but can be non-smooth (e.g., rough, textured, knurled, bumped, spiked, depressed, threaded) or non-flat (e.g., conical, tapered, inwardly depressed, outwardly bumped) or open. The base A1 is internally solid (e.g., a plate), but can be hollow (e.g., a cylinder) or compartmentalized (e.g., with a set of compartments). The base A1 includes a metal or a metal alloy, but can include other materials (e.g., plastic, rubber, wood, silicon). The base A1 is rigid (e.g., unable to be manually bent), but can be flexible (e.g., able to be manually bent).

The base A1 can be secured or configured to be secured to the first end portion C2. For example, the disc of the base A1 has the outer surface that can be configured to contact the first end portion C2. For example, the base A1 and the body C1 can form a T-shape. The base A1 can be monolithic (e.g., a single unit including a same material, additively manufactured, 3d printed, cast, injection molded) with the first end portion C2. For example, the disc of the base A1 can be monolithic with the first end portion C2. The base A1 can be assembled with the first end portion C2 (e.g., by fastening, mating, interlocking, mounting, bracketing, hinging, friction fit, ratcheting, elastically engaging, resiliently engaging, magnetizing). For example, the disc of the base A1 can be assembled with the first end portion C2. The axis C4 extends through the base A1. This extension can be central to the base A1 or non-central to the base A1. The base A1 is non-removable from the first end portion C2. However, this configuration can vary and the base A1 can be removable from the first end portion C2 (e.g., fasten, mate, interlock).

The first wall A2 and the second wall A3 oppose each other, are spaced apart from each other, and extend from the base A1 such that the a general U-shape is formed thereby and the volume of space A4 is formed thereby and extends therebetween. However, note that this configuration can vary and other general shapes can be formed. For example, some of these shapes include a V-shape, a C-shape, or others. Each of the first wall A2 and the second wall A3 extend from the base A1 generally perpendicularly or away from the first end portion C2, the body C1, or the second end portion C3. For example, at least one of the first wall A2 or the second wall A2 forms an L-shape with the base A1. However, note that at least one of the first wall A2 or the second wall A3 can non-perpendicularly extend from the base A1, whether acutely or obtusely. For example, at least one of the first wall A2 or the second wall A3 can be inclined towards each other or away from each other. For example, the first wall A2 and the second wall A3 can extend from the base A1 such that a Y-shape is formed. Although each of the first wall A2 and the second wall A3 tapers in width (e.g., reduces in width) away from the base A1, this configuration can vary. For example, at least one of the first wall A2 or the second wall A3 may not taper in width away from the base A1 (e.g., be uniform in width) or may increase in width while extending away from the base A1.

Each of the first wall A2 and the second wall A3 includes an outer surface and an inner surface opposing the outer surface. The inner surface is exposed to, faces, or contacts the bridge B. Each of the first wall A2 and the second wall A3 is smooth, but can be non-smooth (e.g., rough, textured, knurled, bumped, spiked, depressed, threaded). Each of the first wall A2 and the second wall A3 is internally solid, but can be hollow or compartmentalized. Each of the first wall A2 and the second wall A3 includes a metal or a metal alloy, but can include other materials (e.g., plastic, rubber, wood, silicon). Each of the first wall A2 and the second wall A3 is rigid (e.g., unable to be manually bent), but can be flexible (e.g., able to be manually bent). Each of the first wall A2 and the second wall A3 is monolithic (e.g., a single unit including a same material, additively manufactured, 3d printed, cast, injection molded), but can be an assembly of parts (e.g., by fastening, mating, interlocking). Each of the first wall A2 and the second wall A3 is monolithic (e.g., a single unit including a same material, additively manufactured, 3d printed, cast, injection molded) with the base A1, but can be assembled (e.g., by fastening, mating, interlocking) with the base A1. Although each of the first wall A2 and the second wall A3 is positionally fixed relative to the base A1 and non-removable from the base A1, at least one of the first wall A2 or the second wall A3 can be positionally movable relative to the base A1 (e.g., pivot, swing, rotate) or be removable from the base A1 (e.g., via fastening, mating, interlocking). For example, at least one of the first wall A2 or the second wall A3 can be hingedly connected to the base A1 and can pivot, rotate, or swing thereby relative to the base A1.

The bridge B spans between the first wall A2 and the second wall A3 along the volume of space A4, whether such span is internal to the volume of space A4 or external to the volume of space A4. The bridge B extends longitudinally rectilinear over the base A1 along the volume of space A4, but can extend non-rectilinearly (e.g., U-shape, C-shape, V-shape, helical, sinusoidal, arcuate) over the base A1 along the volume of space A4, whether concave or convex along a horizontal plane, a vertical plane, or a diagonal plane relative to the ear. The bridge B is monolithic (e.g., a single unit including a same material, additively manufactured, 3d printed, cast, injection molded), but can be an assembly of parts (e.g., by fastening, mating, interlocking). The bridge B is monolithic (e.g., a single unit including a same material, additively manufactured, 3d printed, cast, injection molded) with each of the first wall A2 and the second wall A2, but can be assembled (e.g., by fastening, mating, interlocking) with at least one of the first wall A2 or the second wall A2. Although the bridge B is positionally fixed relative to each of the first wall A2 and the second wall A3 and non-removable from each of the first wall A2 and the second wall A3, the bridge B can be positionally movable relative to at least one of the first wall A2 or the second wall A3 (e.g., pivot, swing, rotate) or be removable from at least one of the first wall A2 or the second wall A3 (e.g., via fastening, mating, interlocking). For example, the bridge B can be movable (e.g., pivoting via a hinge secured to at least one of the first wall A2 or the second wall A3 and the bridge B) relative to at least one of the first wall A2 or the second wall A3 such that the ring D is removable therefrom.

The bridge B at least one of intersects or traverses the axis C4 when the base A1 is secured to the first end portion C2, although this can vary and the bridge B can avoid at least one of intersecting or traversing the axis C4 when the base A1 is secured to the first end portion. The bridge B has a cross-section that is circular, but this shaping can vary (e.g., polygonal, oval, triangular, pentagonal, hexagonal, square, rectangular, symmetrical, asymmetrical, open-shape, closed-shape). The bridge B includes an outer surface that is smooth, but can be non-smooth (e.g., rough, textured, knurled, bumped, spiked, depressed, threaded). The bridge B is internally solid (e.g., a bar), but can be hollow (e.g., a cylinder) or compartmentalized (e.g., with a set of compartments). The bridge B includes a metal or a metal alloy, but can include other materials (e.g., plastic, rubber, wood, silicon). The bridge B is rigid (e.g., unable to be manually bent), but can be flexible (e.g., able to be manually bent). The bridge B is monolithic (e.g., a single unit including a same material, additively manufactured, 3d printed, cast, injection molded), but can be an assembly of parts (e.g., by fastening, mating, interlocking).

The ring D loops over the bridge B between the first wall A2 and the second wall A3 such that the ring D is configured to (a) freely slide along the bridge B between the first wall A2 and the second wall A3 and (b) freely rotate about the bridge B between the first wall A2 and the second wall A3. The ring D has an O-shape, but closed shapes or open shapes can be used, whether symmetrical or asymmetrical. For example, the ring can be D-shape, 0-shaped, A-shape, an open shape that is open smaller than how thick the bridge B is, or other shapes. The ring D is monolithic (e.g., a single unit including a same material, additively manufactured, 3d printed, cast, injection molded), but can be an assembly of parts (e.g., by fastening, mating, interlocking). The ring D may or may not at least one of intersects or traverses the axis C4 when the base A1 is secured to the first end portion C2. The ring D has a cross-section that is circular, but this shaping can vary (e.g., polygonal, oval, triangular, pentagonal, hexagonal, square, rectangular, symmetrical, asymmetrical, open-shape, closed-shape). The ring D includes an outer surface that is smooth, but can be non-smooth (e.g., rough, textured, knurled, bumped, spiked, depressed, threaded). The ring D is internally solid (e.g., a bar), but can be hollow (e.g., a cylinder) or compartmentalized (e.g., with a set of compartments). The ring D includes a metal or a metal alloy, but can include other materials (e.g., plastic, rubber, wood, silicon). The ring D is rigid (e.g., unable to be manually bent), but can be flexible (e.g., able to be manually bent). The ring D can be non-detachable from the bridge B or selectively detachable from the bridge B. For example, the ring D can be non-detachable from the bridge B when the ring D is fully closed-shaped. Likewise, for example, the ring may not have a fully closed-shape but be overlappingly closed by its two respective end portions which may be manually pulled away from each other top create a space sized to fit the bridge B and thereby cause the ring D to be removed from the bridge B.

The decorative piece E includes a first side E1 with a first decorative face E2 and a second side E3 with a second decorative face E4. The decorative piece E is secured to the ring D. The first side E1 opposes the second side E3. The first decorative face E2 is aesthetically different from the second decorative face E4. The decorative piece E longitudinally extends along an axis E5 (e.g., an axis of rotation, an axis of symmetry), that also diametrically extends through or spans the ring D. The axis E5 is perpendicular to the axis C4, but this configuration can vary. For example, the axis E5 can be non-perpendicular to the axis C4 (e.g., acute, obtuse). The decorative piece E is monolithic (e.g., a single unit including a same material, additively manufactured, 3d printed, cast, injection molded), but can be an assembly of parts (e.g., by fastening, mating, interlocking). The decorative piece E is secured to the ring D. For example, the decorative piece E can be monolithic (e.g., a single unit including a same material, additively manufactured, 3d printed, cast, injection molded) with the ring D or assembled (e.g., by fastening, mating, interlocking) with the decorative piece E. For example, the decorative piece E can be non-detachable from the ring D or be selectively detachable from the ring D (e.g., magnets, fastening, interlocking, mating). The decorative piece E can be positionally fixed relative to the ring D or can positionally move relative to the ring D. For example, the decorative piece E can spin about the axis E5 relative to the ring D or pivot relative to the ring D. The decorative piece E has an elongated body and a wedge end portion terminating the elongated body distal to the ring D. However, note that the decorative piece E can have any suitable configuration while having the first side E1 with the first decorative face E2 and the second side E3 with a the second decorative face E4. The elongated body of the decorative piece E has a generally perpendicular cross-section, although this configuration can vary (e.g., polygonal, triangular, pentagonal, hexagonal, square, oval, circular, symmetrical, asymmetrical). The wedge end portion can be absent. The decorative piece E is internally solid (e.g., a bar), but can be hollow (e.g., a cylinder) or compartmentalized (e.g., with a set of compartments). The decorative piece E includes a metal or a metal alloy, but can include other materials (e.g., plastic, rubber, wood, silicon). The decorative piece E is rigid (e.g., unable to be manually bent), but can be flexible (e.g., able to be manually bent). The first face E2 has a set of stones disposed rectilinearly along the axis E5 along the elongated body thereof. Note that the set of stones can be omitted or vary in number, structure, arrangement, design, optics, weight, volume, size, shape, or other properties. As such, the decorative piece E is not limited in design to FIGS. 1-39. Therefore, FIGS. 40-51 show various embodiments of other designs of the decorative piece E, each having the first side E1 with the first decorative face E2 and the second side E3 with the second decorative face E4, as disclosed herein.

As shown in FIGS. 1-10, 14-25, and 28-32, the frontal piece A can be configured to rotate (e.g., about 180 degrees, about 360 degrees, about 540 degrees, about 720 degrees) relative to an ear of a wearer based on rotating the decorative piece E (e.g., a clock-like action where a minute hand rotates about a dial) relative to the ear (e.g., about 180 degrees clockwise or counterclockwise), which can be relative to, coaxial to, parallel to, non-parallel to, or about the axis C4. Likewise, as shown in FIGS. 33-36, the frontal piece A can be configured to rotate relative to the ear based on the decorative piece E spinning (e.g., a spinning action about its own longitudinal axis like a spinning top) relative to the ear (e.g., about 180 degrees clockwise or counterclockwise), which can be relative to, coaxial to, parallel to, non-parallel to, or about the axis E5. These modalities of operation (rotating the decorative piece E in a clock-like action and spinning the decorative piece E in a spinning action) cause the first side E1 with the first decorative face E2 not facing the wearer and the second side E3 with the second decorative face E4 facing the wearer to reverse such that the first side E1 with the first decorative face E2 faces the wearer and the second side E3 with the second decorative face E4 does not face the wearer while the post C extends through the ear between the first end portion C2 and the second end portion C3.

As such, the earring 100 can be selectively reversible between different aesthetic appearances for wearing to different occasions or for aesthetically matching with different items of clothing. This selective reversibility is enabled through various modalities of operation (e.g., clock-like action rotation of the decorative piece E, spinning action of the decorative piece E). These modalities of operation are technologically beneficial because these modalities of operation enable the earring 100 to be selectively reversed from various ear portions. For example, when the body C1 extends through the earlobe, the earring 100 can be reversed via rotating the decorative piece E (e.g., a clock-like action where a minute hand rotates about a dial) or spinning the decorative piece E (e.g., a spinning action about its own longitudinal axis like a spinning top). The wearer may decide on which modality of operation to use based on various factors (e.g., headphones worn, hat worn, hijab worn, other potentially interfering earrings). However, when the body C1 does not extend through the earlobe but extends through another portion of the ear (e.g., the helix, the concha), then reversing the decorative piece E via rotating the decorative piece E (e.g., a clock-like action where a minute hand rotates about a dial) may be laborious, time-consuming, complicated, or even impossible (e.g., due to interference with ear anatomy). For example, each of FIG. 26, FIG. 27, FIG. 38, and FIG. 39 illustrates multiple earrings 100 being worn in different portions of the ear. As such, the wearer may rotate the decorative piece E by spinning the decorative piece E (e.g., a spinning action about its own longitudinal axis like a spinning top). Therefore, these modalities of operation are technologically beneficial because these modalities of operation enable the earring 100 to be selectively reversed from various ear portions.

For example, as shown in FIGS. 1-10, 14-25, and 28-32, rotating the decorative piece E about 180 degrees from a 6 o'clock position to a 12 o'clock position about the axis C4 enables the decorative piece E to reverse based on the decorative piece E flipping away from the ear (e.g., about an axis generally perpendicular to the axis C4 or about the bridge B) via the ring D freely rotating about the bridge B between the first wall A2 and the second wall A3 and freely sliding on the bridge B along the bridge B such that the first side E1 with the first decorative face E2 faces the wearer and the second side E3 with the second decorative face E4 does not face the wearer while the post C extends through the ear between the first end portion C2 and the second end portion C3. Likewise, for example, as shown in FIGS. 33-36, spinning the decorative piece E about the axis E5 enables the frontal piece A to simultaneously rotate relative the ear (e.g., about the axis C4), whether together with the post C or relative to the post C, such that the first side E1 with the first decorative face E2 faces the wearer and the second side E3 with the second decorative face E4 does not face the wearer while the post C extends through the ear between the first end portion C2 and the second end portion C3.

Note that the post C can extend through the ear between the first end portion C2 and the second end portion C3 when the body C1 extends through a portion of an ear of a wearer. For example, the portion of the ear can include an earlobe (lobule), a helix, a concha, a superior concha, a crus, a superior crus, an antitragus, an antihelix, a scapha, a triangular fossa, a concha cymba, a tragus, or other suitable portions of the ear. The body C1 can extend through the portion of the ear while the body C1 extends along at least one of a horizontal plane, a diagonal plane, a vertical plane, or a plane that is at least one of horizontal, diagonal, vertical, perpendicular, non-perpendicular, parallel, non-parallel to at least one of a sagittal plane of the wearer, a coronal plane of the wearer, or a transverse plane of the wearer. As such, whether the frontal piece A is rotating based on rotating the decorative piece E (e.g., clock-like action) or spinning the decorative piece E (e.g., a spinning action), the decorative piece E can reverse between the first face E2 and the second face E4 while the body C1 extends through the portion of the ear and the body C1 extends along at least one of a horizontal plane, a diagonal plane, a vertical plane, or a plane that is at least one of horizontal, diagonal, vertical, perpendicular, non-perpendicular, parallel, non-parallel to at least one of a sagittal plane of the wearer, a coronal plane of the wearer, or a transverse plane of the wearer.

As shown in FIGS. 1-10, 14-25, and 28-32, the frontal piece A and the post C can be configured to rotate together (e.g., about the axis C4) relative to the ear based on at least one of rotating the decorative piece E relative to the ear or spinning the decorative piece E relative to the ear and thereby cause the first side E1 with the first decorative face E2 not facing the wearer and the second side E3 with the second decorative face E4 facing the wearer to reverse such that the first side E1 with the first decorative face E2 faces the wearer and the second side E3 with the second decorative face E4 does not face the wearer while the post C extends through the ear between the first end portion C2 and the second end portion C3. In such configuration, the frontal piece A and the post C can be monolithic, as disclosed herein, or assembled with each other, as disclosed herein. This way, rotating the frontal piece A, whether via rotating the decorative piece E or spinning the decorative piece E, as disclosed herein, causes the post C to simultaneously follow the frontal piece A and rotate accordingly therewith, as guided via the frontal piece A. This can occur while the body C1 extends through the portion of the ear and the body C1 extends along at least one of a horizontal plane, a diagonal plane, a vertical plane, or a plane that is at least one of horizontal, diagonal, vertical, perpendicular, non-perpendicular, parallel, non-parallel to at least one of a sagittal plane of the wearer, a coronal plane of the wearer, or a transverse plane of the wearer.

Note that the frontal piece A can be configured to rotate (e.g., about the axis C4) relative to the ear and relative to the post C based on at least one of rotating the decorative piece E relative to the ear and relative to the post or spinning the decorative piece E relative to the ear and relative to the post. In such configuration, the frontal piece A and the post C assembled with each other, as disclosed herein. These actions cause the first side E1 with the first decorative face E2 not facing the wearer and the second side E3 with the second decorative face E4 facing the wearer to reverse such that the first side E1 with the first decorative face E2 faces the wearer and the second side E3 with the second decorative face E4 does not face the wearer while the post C extends through the ear between the first end portion C2 and the second end portion C3, as disclosed herein. This can occur while the body C1 extends through the portion of the ear and the body C1 extends along at least one of a horizontal plane, a diagonal plane, a vertical plane, or a plane that is at least one of horizontal, diagonal, vertical, perpendicular, non-perpendicular, parallel, non-parallel to at least one of a sagittal plane of the wearer, a coronal plane of the wearer, or a transverse plane of the wearer.

As shown in FIGS. 23-26 and 38-39, when the ear includes the earlobe or when the earlobe is absent, the frontal piece A can be configured to rotate relative to the ear based on at least one of rotating the decorative piece E relative to the ear or spinning the decorative piece E relative to the ear and thereby cause the first side E1 with the first decorative face E2 not facing the wearer and the second side E3 with the second decorative face E4 facing the wearer to reverse such that the first side E1 with the first decorative face E2 faces the wearer and the second side E3 with the second decorative face E4 does not face the wearer while the post C extends through the ear not at the earlobe between the first end portion C2 and the second end portion C3. For example, the post C can extend through a helix portion of the ear or a concha portion of the ear.

Note that the frontal piece A can be configured to rotate incrementally (e.g., at a set of preset intervals) relative to the ear based on at least one of rotating the decorative piece E relative to the ear or spinning the decorative piece E relative to the ear and thereby cause the first side E1 with the first decorative face E2 not facing the wearer and the second side E3 with the second decorative face E4 facing the wearer to reverse such that the first side E1 with the first decorative face E2 faces the wearer and the second side E3 with the second decorative face E4 does not face the wearer while the post C extends through the ear between the first end portion C2 and the second end portion C3. This form of rotation can be implemented in various ways. For example, there may be internal stations (e.g., 6 o'clock, 9 o'clock, 12 o'clock, 3 o'clock) within the frontal piece A or the post C. Likewise, there may be a gear mechanism or a ratcheting mechanism within the frontal piece A or the post C. For example, the set of preset intervals can be set as desired, whether at a range of degrees of within a range of rotation (e.g., about 360 degrees or less or more) or by a degree of rotation within a range of rotation (e.g., about 360 degrees or less or more).

The frontal piece A can be configured to rotate freely (e.g., with no preset intervals) relative to the ear based on at least one of rotating the decorative piece E relative to the ear or spinning the decorative piece E relative to the ear and thereby cause the first side E1 with the first decorative face E2 not facing the wearer and the second side E3 with the second decorative face E4 facing the wearer to reverse such that the first side E1 with the first decorative face E2 faces the wearer and the second side E3 with the second decorative face E4 does not face the wearer while the post C extends through the ear between the first end portion C2 and the second end portion C3. This form of rotation can be implemented in various ways. For example, at least one of the frontal piece A or the post C may include a collar to prevent disconnection therebetween and the frontal piece A may be rotationally mounted onto the post C (e.g., via or at the first end portion C2) such that the frontal piece A can freely rotate relative to the post C.

The earring 100 can include a motor (or actuator or another mover) configured to rotate the frontal piece A relative to the ear and relative to the post C. For example, the motor can include an electric motor (e.g., brushed, brushless) powered by a power source (e.g., a capacitor, a battery). The frontal piece A or the post C can host (e.g., internally) at least one of the motor or the power source. For example, the battery can be rechargeable or be a coin battery or a cylindrical cell battery (e.g., an AA battery) or any other suitable battery.

In one mode of operation, an entity may cause the wearer to receive the earring 100 and then rotate the frontal piece 100 relative to the ear such that the decorative piece E reverses from one aesthetic appearance to another aesthetic appearance, as disclosed herein. Also, an entity may manufacture the earring and instruct the wearer to reverse the earring 100 from one aesthetic appearance to another aesthetic appearance, as disclosed herein. Further, note that the earring 100 can be included in a pair of earrings, whether each member of the pair is the earring 100 or one member of the pair is the earring 100.

Various corresponding structures, materials, acts, and equivalents of all means or step plus function elements in various claims below are intended to include any structure, material, or act for performing the function in combination with other claimed elements as specifically claimed. Various embodiments were chosen and described in order to best disclose various principles of this disclosure and various practical applications thereof, and to enable others of ordinary skill in a pertinent art to understand this disclosure for various embodiments with various modifications as are suited to a particular use contemplated.

This detailed description has been presented for various purposes of illustration and description, but is not intended to be fully exhaustive or limited to this disclosure in various forms disclosed. Many modifications and variations in techniques and structures will be apparent to those of ordinary skill in an art without departing from a scope and spirit of this disclosure as set forth in various claims that follow. Accordingly, such modifications and variations are contemplated as being a part of this disclosure. Scope of this disclosure is defined by various claims, which include known equivalents and unforeseeable equivalents at a time of filing of this disclosure.

What is claimed is:

1. An earring comprising:

a post including a first end portion and a second end portion, wherein the first end portion opposes the second end portion;

a frontal piece including a base, a first wall, a second wall, and a bridge, wherein the base is secured to the first end portion, wherein the first wall extends from the base, wherein the second wall extends from the base, wherein the first wall and the second wall oppose each other, wherein the first wall and the second wall are spaced apart from each other such that a volume of space extends therebetween, wherein the bridge spans between the first wall and the second wall along the volume of space;

a ring looped over the bridge between the first wall and the second wall such that the ring is configured to (a) freely slide along the bridge between the first wall and the second wall and (b) freely rotate about the bridge between the first wall and the second wall; and a decorative piece secured to the ring, wherein the decorative piece has a first side and a second side, wherein the first side opposes the second side, wherein the first side has a first decorative face, wherein the second side has a second decorative face, wherein the first decorative face is aesthetically different from the second decorative face, wherein the frontal piece is configured to rotate relative to an ear of a wearer based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

2. The earring of claim 1, wherein the frontal piece and the post are configured to rotate together relative to the ear based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

3. The earring of claim 2, wherein the base and the first end portion are monolithic with each other.

4. The earring of claim 2, wherein the base and the first end portion are assembled with each other.

5. The earring of claim 1, wherein the frontal piece is configured to rotate relative to the ear and relative to the post based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

6. The earring of claim 5, wherein the base and the first end portion are assembled with each other.

7. The earring of claim 1, wherein the frontal piece is configured to rotate relative to the ear based on rotating the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

8. The earring of claim 7, wherein the frontal piece is configured to rotate relative to the ear based on rotating the decorative piece relative to the ear and thereby cause the first side with the first decorative face not facing the wearer and the second side with the second decorative face facing the wearer to reverse based on the decorative piece flipping away from the ear via the ring freely rotating about the bridge between the first wall and the second wall such that the first side with the first decorative face faces the wearer and the second side with the second decorative face does not face the wearer while the post extends through the ear between the first end portion and the second end portion.

9. The earring of claim 1, wherein at least one of the first wall or the second wall tapers away from the base.

10. The earring of claim 1, wherein the ear includes or excludes an earlobe, wherein the frontal piece is configured to rotate relative to the ear based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear not at the earlobe between the first end portion and the second end portion.

11. The earring of claim 1, wherein the frontal piece is configured to rotate relative to the ear based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends vertically through the ear between the first end portion and the second end portion.

12. The earring of claim 1, wherein the frontal piece is configured to rotate relative to the ear based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends diagonally through the ear between the first end portion and the second end portion.

13. The earring of claim 1, wherein the frontal piece is configured to rotate relative to the ear based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends horizontally through the ear between the first end portion and the second end portion.

14. The earring of claim 1, wherein the ear includes a helix portion, wherein the frontal piece is configured to rotate relative to the ear based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the helix portion between the first end portion and the second end portion.

15. The earring of claim 1, wherein the ear includes a concha portion, wherein the frontal piece is configured to rotate relative to the ear based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the concha portion between the first end portion and the second end portion.

16. The earring of claim 1, wherein the frontal piece is configured to rotate incrementally relative to the ear based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

17. The earring of claim 1, wherein the frontal piece is configured to rotate freely relative to the ear based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

18. The earring of claim 1, wherein the frontal piece is configured to rotate relative to the ear based on spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

19. The earring of claim 1, further comprising:

a mover configured to rotate the frontal piece relative to the ear and relative to the post.

20. The earring of claim 1, wherein the ring is selectively detachable from the bridge.

21. The earring of claim 1, wherein the bridge is movable relative to at least one of the first wall or the second wall such that the ring is removable therefrom.

22. The earring of claim 1, wherein the decorative piece is selectively detachable from the ring.

23. The earring of claim 1, wherein the post is not longitudinally rectilinear.

24. The earring of claim 1, wherein the post is longitudinally rectilinear.

25. The earring of claim 1, wherein the frontal piece is configured to rotate at least about 180 degrees relative to the ear of the wearer based on rotating the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

26. The earring of claim 1, wherein the frontal piece is configured to rotate at least about 180 degrees relative to the ear of the wearer based on spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

27. The earring of claim 1, wherein at least of the first wall or the second wall does not taper away from the base.

28. The earring of claim 1, wherein the bridge is rectilinear and the ring has a closed-shape.

29. A method comprising:

manufacturing an earring comprising a post, a frontal piece, a ring, and a decorative piece, wherein the post including a first end portion and a second end portion, wherein the first end portion opposes the second end portion, wherein the frontal piece including a base, a first wall, a second wall, and a bridge, wherein the base is secured to the first end portion, wherein the first wall extends from the base, wherein the second wall extends from the base, wherein the first wall and the second wall oppose each other, wherein the first wall and the second wall are spaced apart from each other such that a volume of space extends therebetween, wherein the bridge spans between the first wall and the second wall along the volume of space, wherein the ring is looped over the bridge between the first wall and the second wall such that the ring is configured to (a) freely slide along the bridge between the first wall and the second wall and (b) freely rotate about the bridge between the first wall and the second wall, wherein the decorative piece is secured to the ring, wherein the decorative piece has a first side and a second side, wherein the first side opposes the second side, wherein the first side has a first decorative face, wherein the second side has a second decorative face, wherein the first decorative face is aesthetically different from the second decorative face; and instructing a wearer to rotate the frontal piece relative to the ear based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

30. A method comprising:

causing a wearer having an ear to receive an earring comprising a post, a frontal piece, a ring, and a decorative piece, wherein the post including a first end portion and a second end portion, wherein the first end portion opposes the second end portion, wherein the frontal piece including a base, a first wall, a second wall, and a bridge, wherein the base is secured to the first end portion, wherein the first wall extends from the base, wherein the second wall extends from the base, wherein the first wall and the second wall oppose each other, wherein the first wall and the second wall are spaced apart from each other such that a volume of space extends therebetween, wherein the bridge spans between the first wall and the second wall along the volume of space, wherein the ring is looped over the bridge between the first wall and the second wall such that the ring is configured to (a) freely slide along the bridge between the first wall and the second wall and (b) freely rotate about the bridge between the first wall and the second wall, wherein the decorative piece is secured to the ring, wherein the decorative piece has a first side and a second side, wherein the first side opposes the second side, wherein the first side has a first decorative face, wherein the second side has a second decorative face, wherein the first decorative face is aesthetically different from the second decorative face; and causing the wearer to rotate the frontal piece relative to the ear based on at least one of rotating the decorative piece relative to the ear or spinning the decorative piece relative to the ear and thereby cause the first side with the first decorative face not facing the wearer and the second side with the second decorative face facing the wearer to reverse such that the first side with the first decorative face faces the wearer and the second side with the second decorative face does not face the wearer while the post extends through the ear between the first end portion and the second end portion.

* * * * *